US010626591B2

(12) United States Patent
Muderlak et al.

(10) Patent No.: US 10,626,591 B2
(45) **Date of Patent: *Apr. 21, 2020**

(54) ADJUSTABLE FIXTURE SCREEN SYSTEM

(71) Applicant: Xela Innovations, LLC, Glendale, WI (US)

(72) Inventors: Todd J. Muderlak, Whitefish Bay, WI (US); Kenneth J. Muderlak, Milwaukee, WI (US)

(73) Assignee: Xeia Innovations, LLC, Glendale, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/945,211

(22) Filed: Apr. 4, 2018

(65) Prior Publication Data

US 2018/0328015 A1 Nov. 15, 2018

Related U.S. Application Data

(60) Continuation of application No. 15/196,419, filed on Jun. 29, 2016, now Pat. No. 10,066,382, which is a division of application No. 13/839,307, filed on Mar. 15, 2013, now abandoned.

(51) Int. Cl.

| | |
|---|---|
| ***E03D 13/00*** | (2006.01) |
| ***E03D 9/03*** | (2006.01) |
| ***E03C 1/264*** | (2006.01) |

(52) U.S. Cl.

CPC ..... *E03D 13/005* (2013.01); *E03C 1/264* (2013.01); *E03D 9/03* (2013.01); *E03D 13/007* (2013.01)

(58) Field of Classification Search

CPC ..... E03D 13/00; E03D 13/005; E03C 1/26; E03C 1/262–1/264

See application file for complete search history.

(56) References Cited

U.S. PATENT DOCUMENTS

| | | | |
|---|---|---|---|
| 1,494,882 | A | 5/1924 | Barger |
| 2,433,423 | A | 12/1947 | Broadman |
| 3,597,772 | A | 8/1971 | Leavitt et al. |
| 4,210,309 | A | 7/1980 | Grenier |

(Continued)

OTHER PUBLICATIONS

Hybrid H2O HL-28 Urinal; retrieved from url: https://www.sutainablerestroomproducts.com/products/featured-products/hybridh2o-hi-28-waterless-urinal; printed on May 14, 2014; 2 pages.

(Continued)

*Primary Examiner* — Erin Deery
*Assistant Examiner* — Nicholas A Ros
(74) *Attorney, Agent, or Firm* — SmithAmundsen LLC

(57) ABSTRACT

The disclosure provides a urinal screen comprising a flexible screen in a circular configuration having a center portion and a contiguous outer portion encircling the center portion, the outer portion being separated into one or more elongated strips extending outwardly from the center portion, and the center portion having a center hole extending therethrough. When positioned on a surface of a urinal or other fixture, the screen is substantially conformable to the urinal surface without sacrificing the screen objective to keep debris from entering drain. In embodiments, the center portion of the screen can be adjustable in height such that the screen is in a mound- or dome-like configuration and still preventing any debris from entering the drain.

17 Claims, 21 Drawing Sheets

(56) References Cited

U.S. PATENT DOCUMENTS

| | | | | |
|---|---|---|---|---|
| 4,272,052 | A | 6/1981 | Gidner | |
| 5,181,281 | A | 1/1993 | Jang | |
| 5,313,672 | A | 5/1994 | Luedtke et al. | |
| 5,398,347 | A | 3/1995 | Luedke et al. | |
| 5,604,937 | A | 2/1997 | Davenport | |
| 5,711,037 | A | 1/1998 | Reichardt et al. | |
| 6,286,153 | B1 | 9/2001 | Keller | |
| 6,698,035 | B1 | 3/2004 | Grueser | |
| 6,701,541 | B2 | 3/2004 | Romagna et al. | |
| 6,920,648 | B1 | 7/2005 | Suski et al. | |
| 6,959,723 | B2 | 11/2005 | Gorges | |
| 7,246,386 | B2 | 7/2007 | Hall | |
| 7,571,741 | B2 | 8/2009 | Higgins | |
| 7,636,957 | B2 | 12/2009 | Funari | |
| 7,900,288 | B2 | 3/2011 | Fima | |
| 8,231,865 | B2 | 7/2012 | Pliszka | |
| 8,234,723 | B2 | 8/2012 | Allen | |
| 8,291,522 | B2 | 10/2012 | Kueng | |
| 8,322,682 | B2 | 12/2012 | Maercovich | |
| 10,036,154 | B2 * | 7/2018 | Crevier | E03D 13/005 |
| 10,066,382 | B2 * | 9/2018 | Muderlak | E03D 13/005 |
| 2007/0266486 | A1 | 11/2007 | Ramirez | |
| 2008/0295236 | A1 * | 12/2008 | Eichler | E03C 1/264 4/292 |
| 2009/0271920 | A1 | 11/2009 | Viggiano | |
| 2012/0117719 | A1 | 5/2012 | Brooks | |
| 2012/0317707 | A1 | 12/2012 | Romero | |
| 2013/0031708 | A1 * | 2/2013 | Sensel | E03D 13/005 4/309 |
| 2014/0157501 | A1 * | 6/2014 | D'Amico | E03D 13/005 4/256.1 |
| 2018/0347161 | A1 * | 12/2018 | Malesky | E03C 1/264 |
| 2019/0145088 | A1 * | 5/2019 | Keune | E03D 9/005 4/222.1 |

OTHER PUBLICATIONS

Hybrid H2O featured products; retrieved from url: https://www.sustainablerestroomproducts.com/featured-products; printed on Jul. 24, 2013; 2 pages.

Hybrid H2O Waterless Urinal Replacement Cartridges; retrieved from url: https://www.sustainablerestroomproducts.com/waterless-urinal-replacement-cartridges; printed on Jul. 24, 2013; 2 pages.

Hybrid H2O Waterless Urinal Accessories; retrieved from url: https://sustainablerestroomproducts.com/waterless-urinal-accessories; printed on Jul. 24, 2013; 2 pages.

Hybrid H2O "Waterless or Water . . . You Choose Specification!" Specification Sheet; Apr. 2013; 2 pages.

* cited by examiner

ADJUSTABLE FIXTURE SCREEN SYSTEM

FIELD

This disclosure relates to a screen adjustable in height and/or shape for use in a urinal and assemblies that incorporate the screen.

BACKGROUND

Water conservation is a major concern in many areas and is likely to become even more important in the future as populations increase resulting in more water consumption. The largest daily user of water in commercial establishments is the urinal, while other restroom fixtures contribute to the overall high water consumption of commercial establishments.

In order to reduce water consumption, low water and no-water fixtures, such as urinals, have been devised. These no-water and low water fixtures are not flushed each time a person uses the fixture and, in fact, are oftentimes not equipped for flushing as they are not connected to a water supply. As a no-water urinal is repeatedly used, most urine is collected in a compartment of the urinal. Oil sealing liquids, such as organic oils lighter than and immiscible with urine, float on the surface of the collected urine and act as a barrier to prevent odors from escaping. Screens are used to block the collected urine, and any urine or liquid remaining in the urinal, from sight.

Typical screens used in urinals are generally flat sheets completely encircling or covering the drain. The bottom of the screen typically forms a seal with the bottom surface of the urinal. Any liquid (i.e., water, urine) must therefore pass through the perforations of the screen to go down the drain. When there is resting water and urine in the urinal, the perforations, however, have a tendency to get clogged with debris and garbage, restricting liquid flow and resulting in visible standing liquid in the urinal. The standing liquid is unpleasant to view and often emits a foul odor.

It is desirable to provide a urinal screen which is adjustable in height and/or shape to cover or conceal unsightly resting water and urine while also protecting drains from debris and garbage whether in a flat or raised position. It is further desirable to provide a urinal screen which may be used over existing screens (typically those that are affixed to drains with screws) to conceal the existing screen while also protecting drains from debris and deodorizing.

SUMMARY

The present disclosure provides a urinal screen for protecting drains from debris and garbage that can clog pipes, which can optionally be used with additional cleaner/deodorizer blocks, and can be modified in shape to conceal and avoid interference with already installed screens, resting water/urine and/or other drain components. The screen assembly can be used to cover up unsightly urine/water so that it is not viewed by the user. The assembly provides for integration of a screen with cleaning materials (e.g., enzymes, bacteria) in a solid block, gel or liquid form, with or without fragrance additives. The flexibility of the screen allows the assembly to confirm to any urinal shape or other variable surface on which the assembly would be installed to provide a trap screen and ensure that little or no debris enters the drain. The conforming properties of the flexible screen design ensure that the screen lies flat on the contact surface to prevent splashing of urine.

In an embodiment, the disclosure provides a urinal screen, comprising a flexible screen in a circular configuration comprising a center portion and a contiguous outer portion encircling the center portion, the outer portion being separated into one or more elongate strips extending outwardly from the center portion, and the center portion having a center hole extending therethrough, wherein when positioned on a surface of a urinal, the screen is substantially conformable to the urinal surface. In embodiments, the center portion of the screen can be elevated such that the screen is in a mound- or dome-like configuration.

In embodiments of the screen, the outer portion can be structured as a plurality of elongated strips extending radially outward from and in a perpendicular orientation to the center portion, as one or more elongated strips in a spiral configuration, or as a plurality of strips in a zigzag configuration extending outwardly from the center portion, among other configurations. In an embodiment, the outer portion is composed of zigzagged strips with a plurality of bent arm portions connected together at an angle.

In embodiments, the screen can be connected to a module for containing a material (e.g., block, gel or liquid) containing a cleaning agent, fragrance or a combination thereof.

In some embodiments, the urinal screen, with or without a module containing a cleaning/fragrance material, can be combined with an arched support stand, such that the screen is situated over the support stand in a domed configuration.

In an embodiment, a urinal screen assembly according to the disclosure comprises a flexible screen in a circular configuration comprising a center portion and a contiguous outer portion encircling the center portion, the outer portion being separated into one or more elongated strips extending outwardly from the center portion, and the center portion having a center hole extending therethrough; and at least one of a) a fastening element sized for insertion through the center hole of the screen, b) an arched support stand sized for placement of the screen thereover in a domed configuration, and c) a module for containing a cleaner or fragrance block, configured for attachment to the flexible screen. In embodiments, the outer portion of the screen comprises a plurality of elongated strips extending radially outwardly from the center portion.

BRIEF DESCRIPTION OF THE DRAWINGS

Preferred embodiments of the disclosure are described below with reference to the following accompanying drawings, which are for illustrative purposes only. Throughout the following views, the reference numerals will be used in the drawings, and the same reference numerals will be used throughout the several views and in the description to indicate the same or like parts.

DETAILED DESCRIPTION

Embodiments of the disclosure relate to a urinal screen and system for placement over the drain of a urinal. The present urinal screen and assemblies provide a robust design that allows not only for flat installation but can also be raised into a cone or dome-like shape to avoid interference with other drain parts, urine and/or water.

An embodiment of a urinal screen system 10 according to the disclosure is described with reference to FIGS. 1-2. While the embodiments described herein illustrate the use of urinal screen system 10 with a urinal, it is understood that urinal screen system 10 may be used with other fixtures containing drains (e.g., sinks) to prevent debris and other matter from clogging a drain or pipe and cover standing used liquid.

Figure 1:
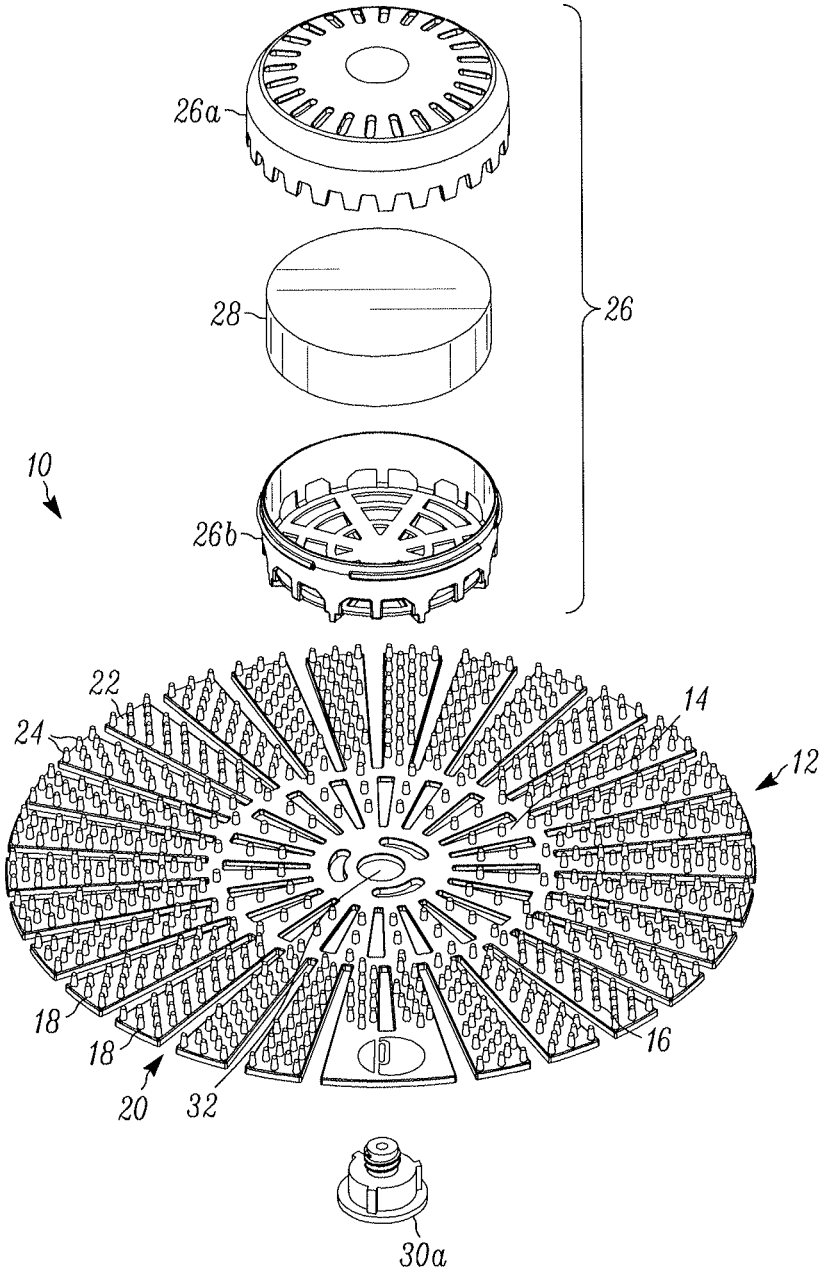
FIG. 1 is a perspective exploded view of an embodiment of a urinal screen assembly according to the disclosure.
Figure 2:
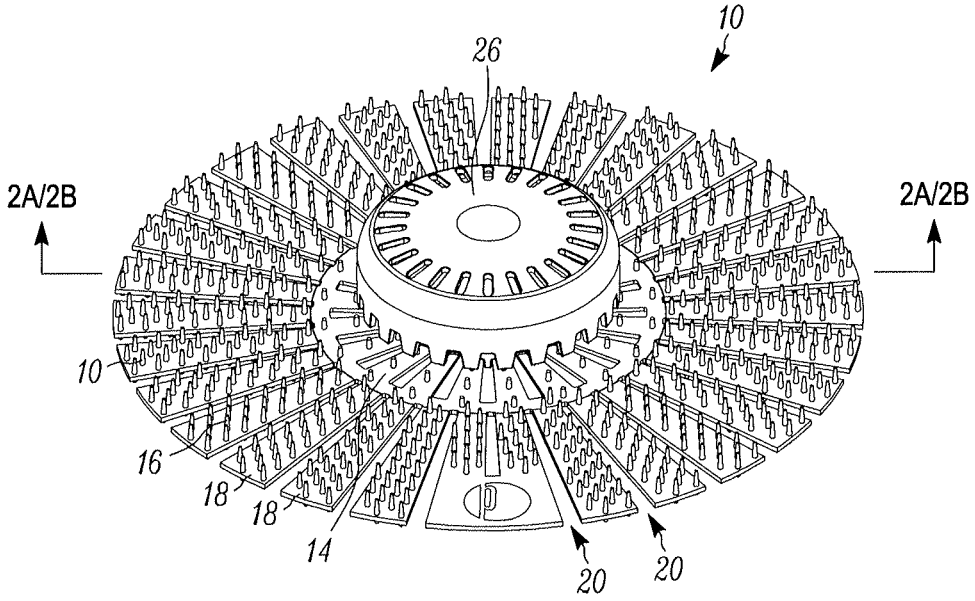
FIG. 2 is a perspective view of the assembled urinal screen assembly of FIG. 1.

Referring to FIG. 1, the urinal screen system 10 comprises a flexible screen 12 in a generally circular configuration comprising a center portion 14 and a contiguous outer portion 16 connected to and encircling the center portion 14. While flexible screen 12 is shown as primarily circular in configuration in the exemplary embodiments illustrated, in further embodiments, flexible screen 12 may have a triangular, rectangular or other configuration provided outer portion 16 was always in physical contact with a fixture surface to prevent debris from entering the drain at all angles.

The outer portion 16 is configured as one or more elongated strips 18 extending outwardly from the center portion 14. The strips 18 are adjacently positioned with narrow slits 20 therebetween. This configuration of the outer portion 16 as one or more strips 18 allows the screen 12, when positioned over the drain of a urinal, to substantially adapt and conform to the contours of the urinal surface and prevent passage of debris into the drain.

Figure 3:
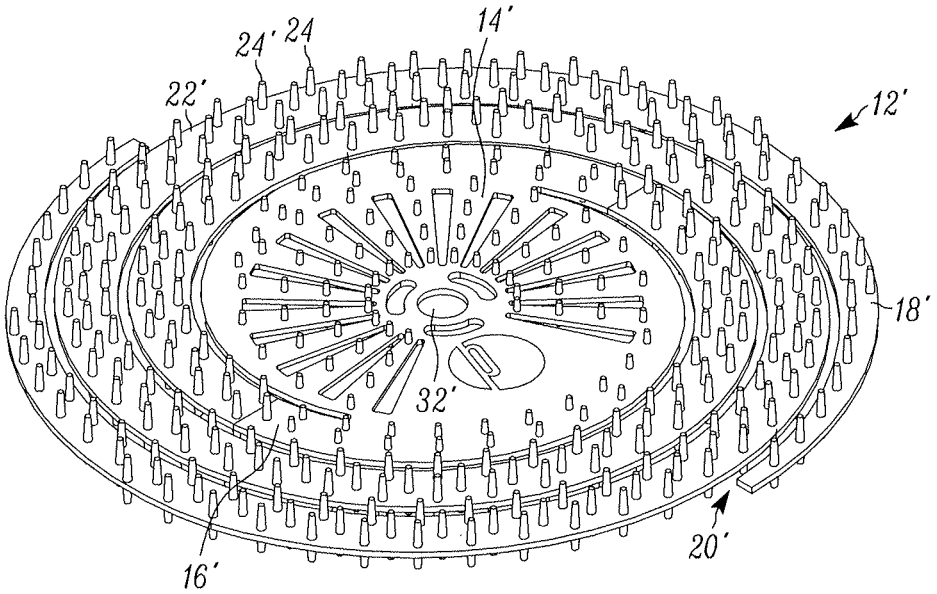
FIGS. 3 and 4 are perspective views of other embodiments of a urinal screen according to the disclosure.
Figure 4:
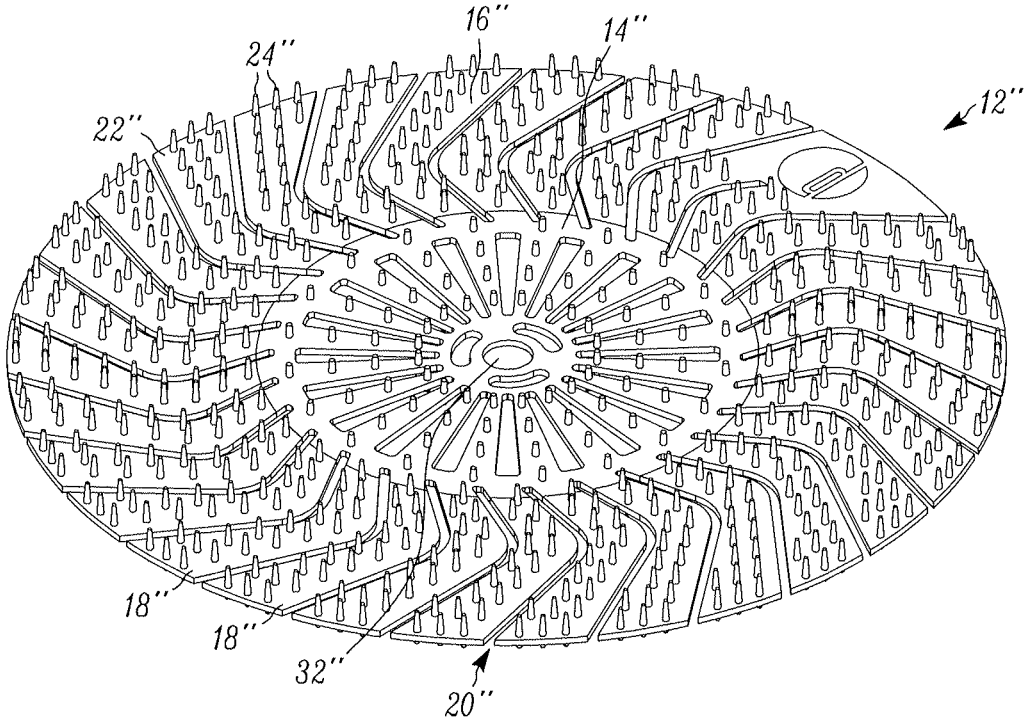

For example, as illustrated in FIG. 1, the outer portion 16 of the urinal screen 12 can be constructed as a plurality of elongate strips 18 that extend radially outward from and in a perpendicular orientation to the center portion 14. Other exemplary embodiments are illustrated in FIGS. 3 and 4. Optionally, as shown in FIG. 1, for example, the surface 22 of one or more of the elongated strips 18 can include multiple protrusions 24 which function to collect debris in use of the urinal screen.

The screen 10 can be manufactured from a variety of flexible materials, for example, a polymeric-based material, silicone, thermoplastic elastomers, thermoplastic olefinic elastomers, and other materials known in the art by compression molding, injection molding or other process known and used in the art. In some embodiments, that material from which screen 10 is made may contain or include a fragrance, antibacterial/antimicrobial agent or other treatment.

Figure 2A:
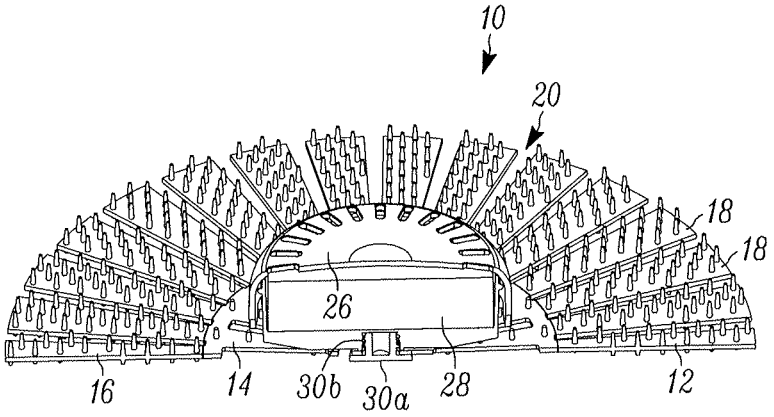
FIG. 2A is a perspective, cross-sectional view
Figure 2B:
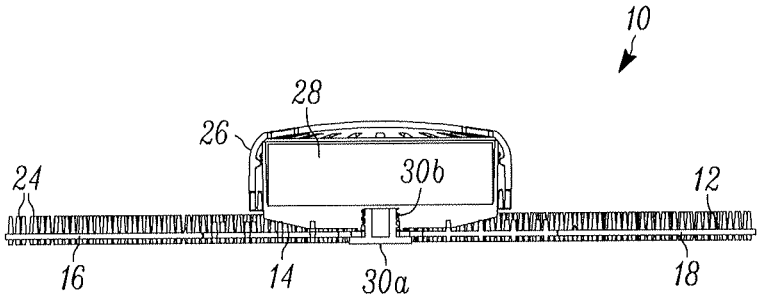
FIG. 2B is an elevational, cross-sectional view of the urinal screen assembly of FIG. 2, taken along lines 2A-2A/2B-2B.

In embodiments, the screen 12 can be used in combination with a module 26 configured for containing an enzyme (cleaner) or fragrance (deodorizer) material 28. As illustrated in FIG. 1, the module 26 includes a cover portion **26*a* and a base portion 26*b*. The module 26 can be positioned over and attached to the screen 12 by means of a fastening element 30*a* (e.g., a threaded fastener) inserted through a center hole 32 within the center portion 14 of the screen, which engages with a mating element 30*b* (e.g., threaded opening) in the base section 26*b* of the module 26, as further shown in FIGS. 2A-2B. In an embodiment, the fastening element 30*a* comprises external threads and the base section 26*b* of the module 26** comprises internal threads, and the fastening element and the module are connected in a threaded engagement.

In another embodiment, as depicted in FIG. 3, the outer portion 16' of the screen 12' can be one or more elongated strips 18' in a spiral configuration. In yet another embodiment, as depicted in FIG. 4, the outer portion 16" of the urinal screen 12" can constitute a plurality of strips 18" in a zigzag or bent configuration that extend outwardly from the center portion 14". In embodiments, the zigzagged strips 18" comprise a plurality of bent arm portions connected together at an angle.

Figure 5:
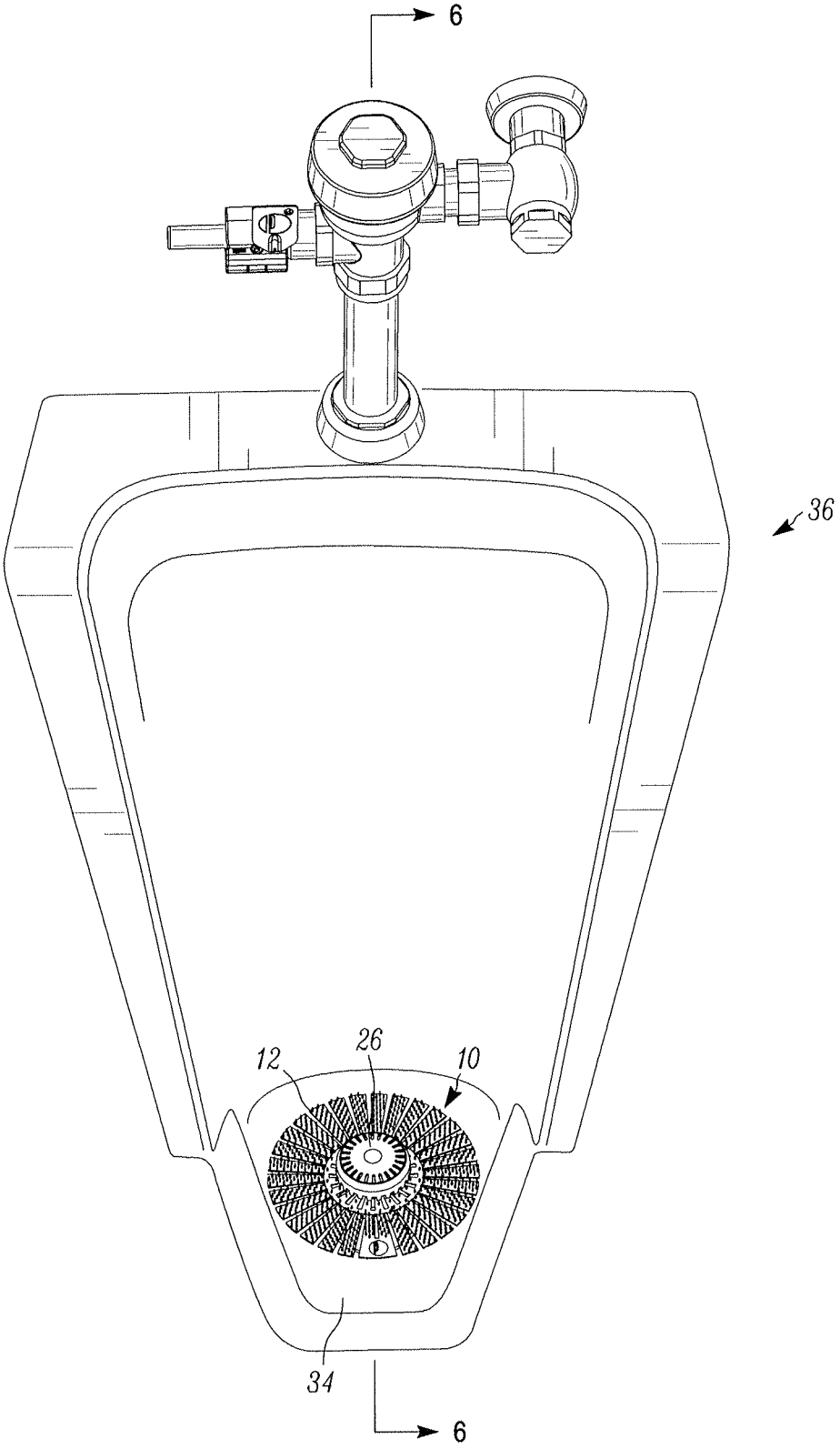
FIG. 5 is a perspective view of the urinal screen assembly of FIG. 1 installed over a drain of an embodiment of a floor mount urinal.
Figure 6:
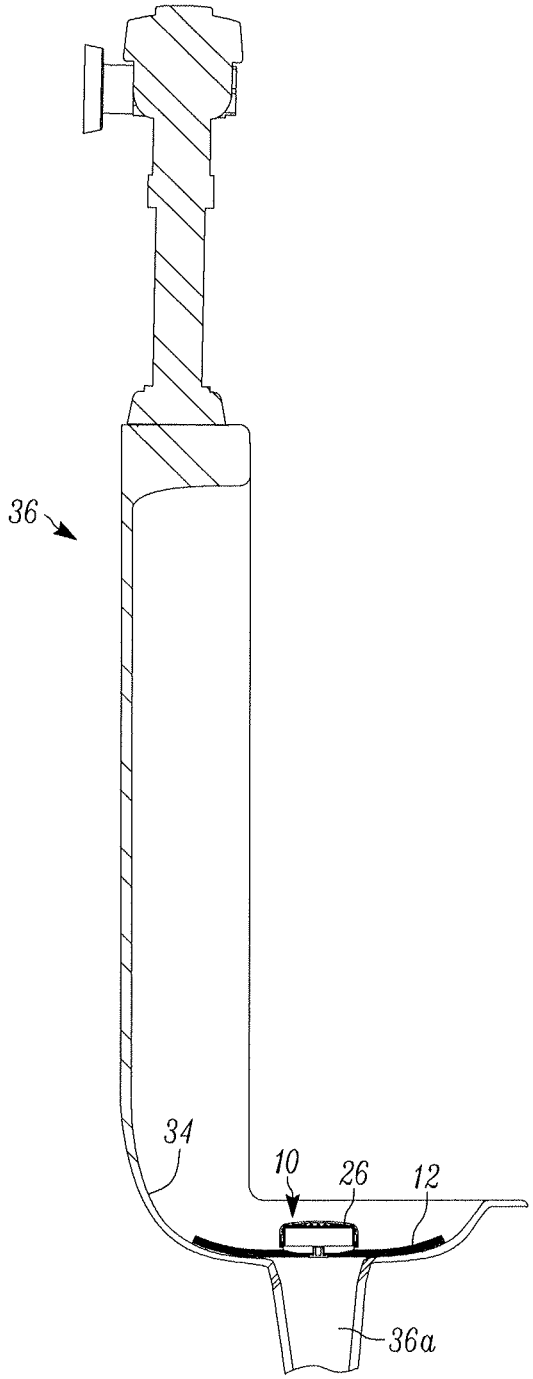
FIG. 6 is an elevational, cross-sectional view of the floor mount urinal and urinal screen assembly depicted in FIG. 5.
Figure 7:
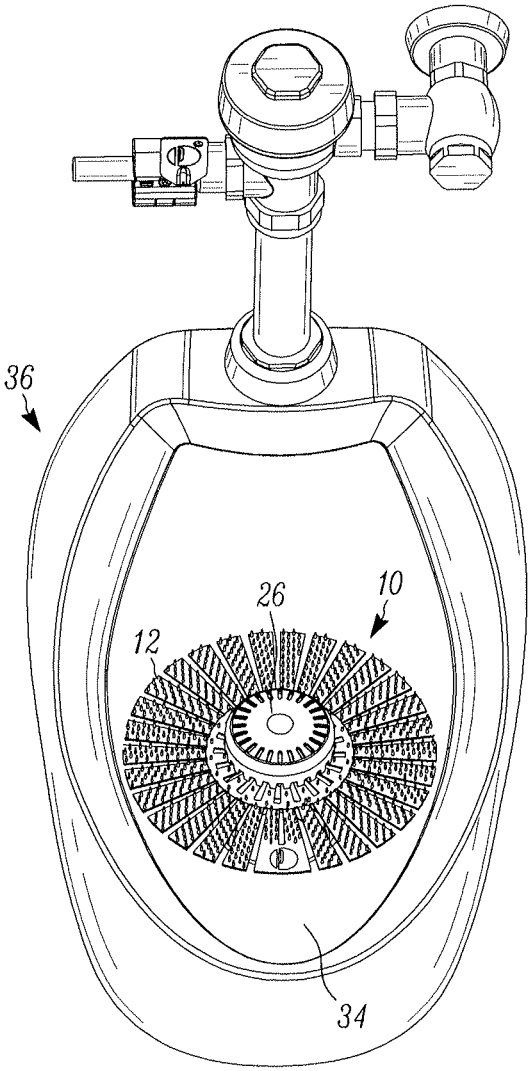
FIG. 7 is a perspective view of the urinal screen assembly of FIG. 1 installed over a drain of an embodiment of a pedestal urinal.
Figure 8:
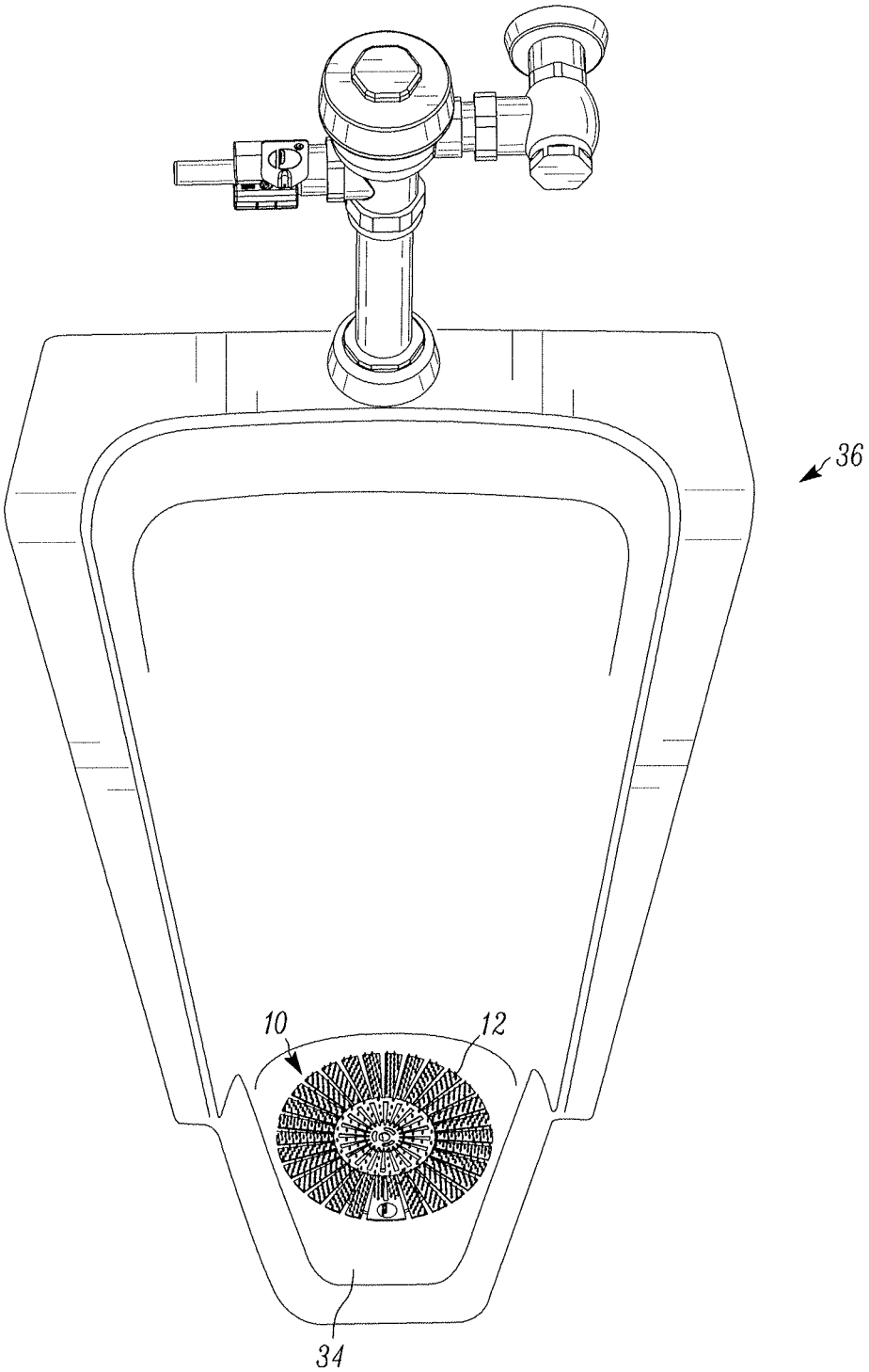
FIG. 8 is a perspective view of the urinal screen shown in FIG. 1 installed over a drain of an embodiment of a floor mount urinal.

Referring to FIGS. 5-8, in use, the screen 10 is adaptable to conform to the contours of the surface 34 of a urinal 36 or other substrate. FIGS. 5, 6 and 8 illustrate screen 10 in use with a floor mounted urinal 36, while FIG. 7 illustrates screen 10 in use with a wall mounted urinal 36. As depicted in FIGS. 1 and 2, the screen 12 can have a substantially flat or planar configuration when positioned on a flat surface but will substantially conform to the contours of the substrate surface, as shown in FIGS. 5-6.

As depicted in FIGS. 5-6, the screen assembly 10 composed of the screen 12 with the attached module 26 containing fragrance/cleaner can be used to screen the urinal drain **36*a* and to freshen the surrounding air. In other embodiments, as shown in FIG. 8, the screen 12** can be used alone over a urinal drain to screen debris from entering.

Figure 9:
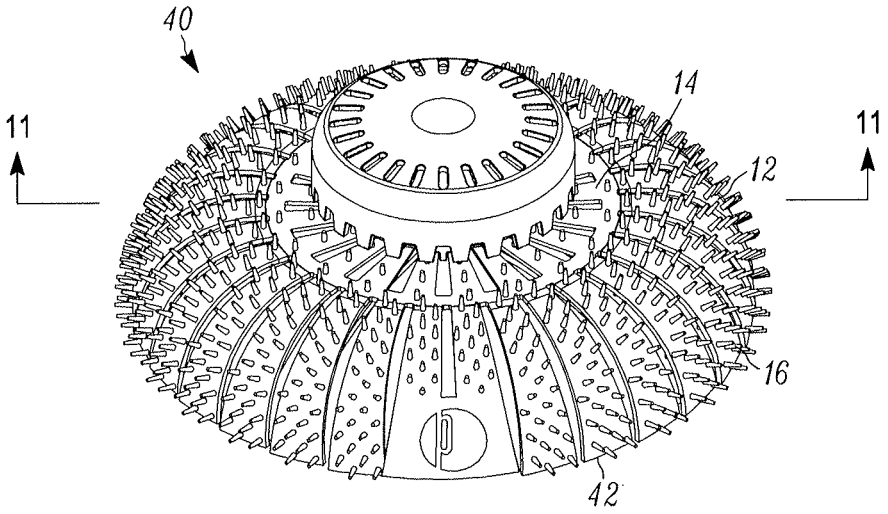
FIG. 9 is a perspective view of an embodiment of a domed urinal screen assembly according to the disclosure in which the screen is mounted on an arched support.
Figure 10:
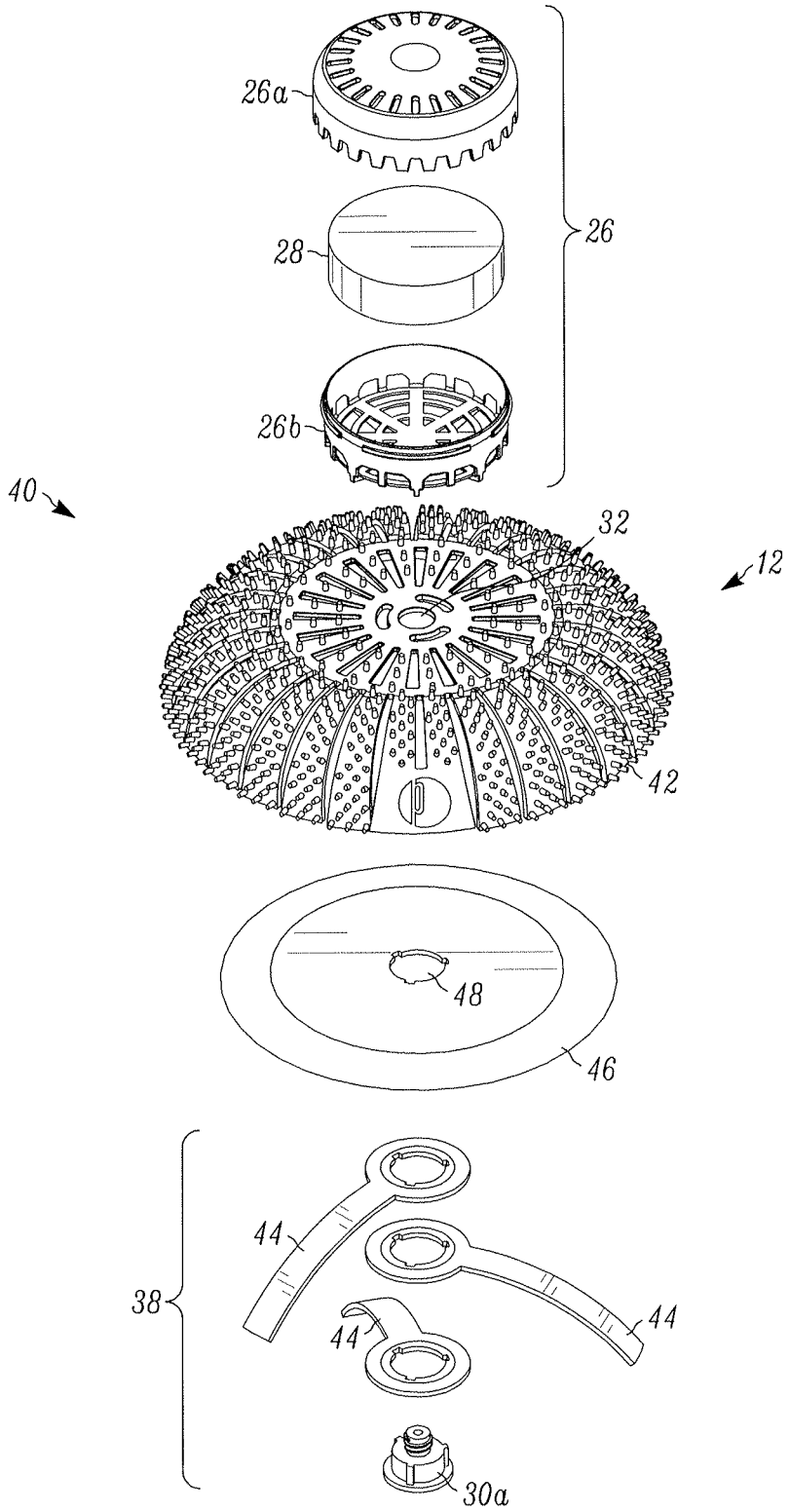
FIG. 10 is a perspective exploded view of the domed urinal screen assembly of FIG. 9.
Figure 11:
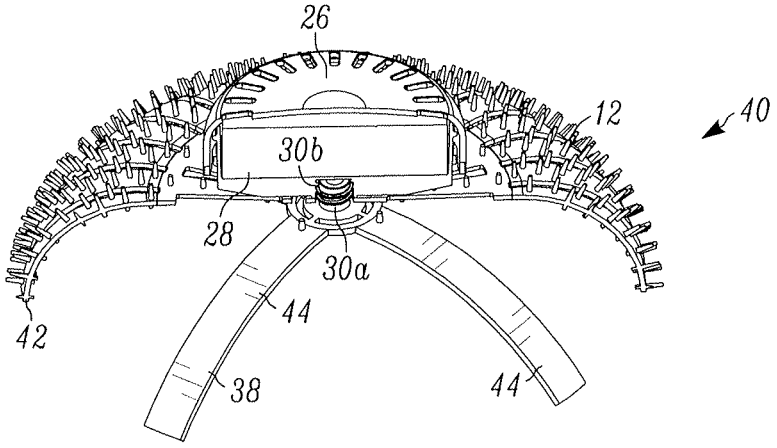
FIG. 11 is a cut-away view of the domed urinal screen assembly of FIG. 9, taken along lines 11-11.

Referring now to FIGS. 9-11, in other embodiments, the center portion 14 of the screen 12 can be elevated by use of an arched support stand 38 that is sized to be positioned under the screen to provide a domed screen assembly 40 with the screen 12 in a domed or mound-like configuration such that the perimeter edge 42 on outer portion 16 of the screen 12 can be placed in contact with a substrate surface. The use of a domed screen assembly 40 is advantageous for hiding unappealing urine if the urinal is not timely flushed or it has been converted to a "low flush" system to reduce water usage.

Figure 12:
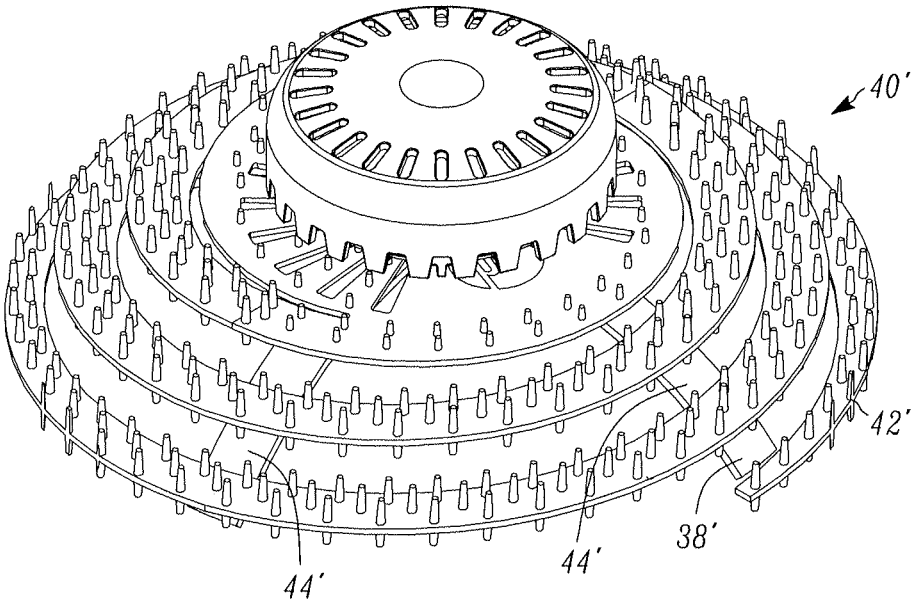
FIGS. 12 and 13 are perspective views of domed urinal screen assemblies utilizing other embodiments of the urinal screen.
Figure 13:
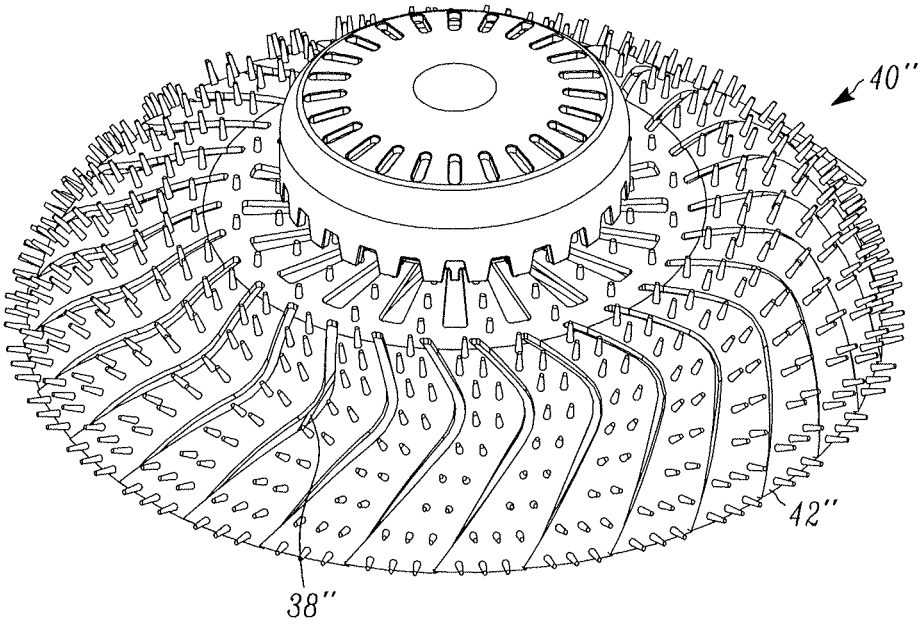

In one embodiment, the arched support stand 38 is composed of a plurality of arched leg sections 44 as depicted in FIGS. 10-11, which are attached together under the screen 12 and to the overlying fragrance/cleaner module 26 by means of a fastener 30*a*. The support stand 38 can be manufactured from a stiff material such as—polypropylene, polyoxymethylene, and other materials known in the art by injection molding and other processes known and used in the art. As shown in FIG. 11, the fastener 30*a* is inserted through center hole 32 within the center portion 14 of the screen 12, to engage the mating element 30*b* in the base section 26*b* of the fragrance/cleaner module 26. A support stand 38 can be used in combination with other embodiments of the screen, as illustrated in FIGS. 12-13.

In the exemplary embodiments shown, the arched leg sections 44 are specifically designed to provide the maximum height at weight center portion 14 of screen 12 may be elevated such that perimeter edge 42 maintains physical contact with a substrate surface around the entire circumference of screen 12. The maximum height is therefore dependent on the overall radius of screen 12 and the flexibility and/or rigidity of outer portion 16, as well as the size of corresponding arched support stand 38 (and leg portions 44 and/or domed center section 50 as in FIGS. 14-15). In further embodiments, support stand 38 and/or arched leg sections 44 or domed center section 50 (as seen in FIGS. 14-15) may be adjustable in height up to the maximum height.

Optionally, as shown in FIG. 10, a flexible, circular support structure 46 having a center opening 48 can be positioned between the screen 10 and the arched support 38. The circular support structure 46 can be fabricated from polypropylene, polyoxymethylene or other material known in the art.

Figure 14:
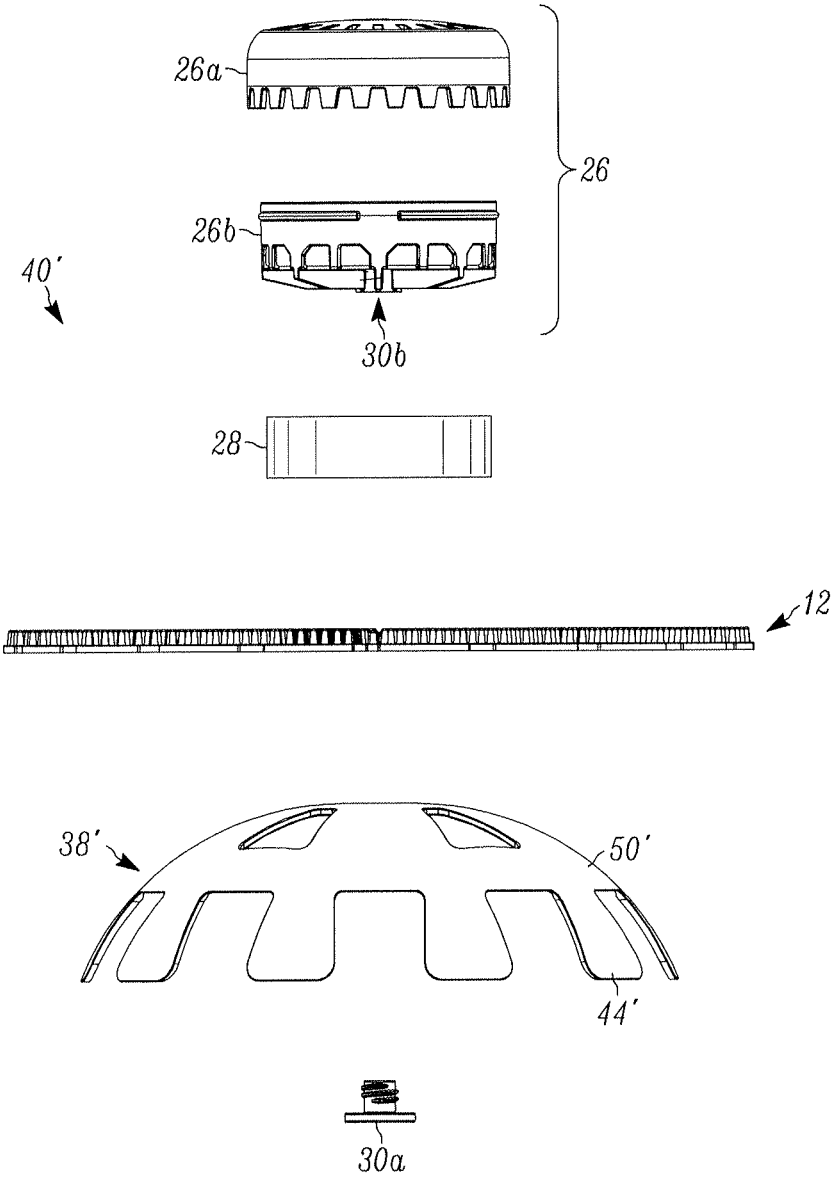
FIG. 14 is an exploded view of another embodiment of a domed urinal screen assembly according to the disclosure.
Figure 15:
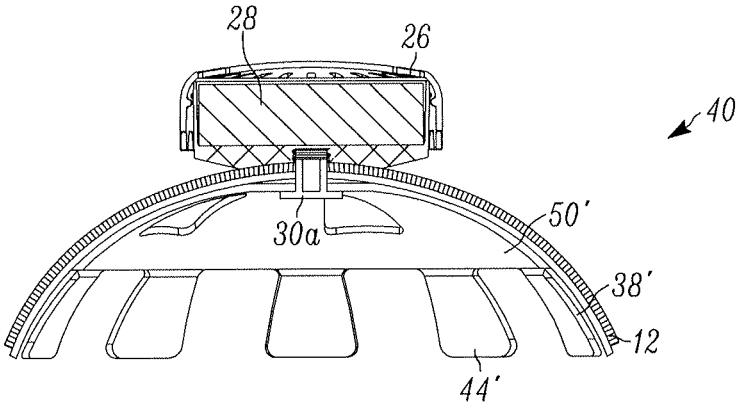
FIG. 15 is an elevational, cross-sectional view of the assembled domed urinal screen assembly of FIG. 14.
Figure 16:
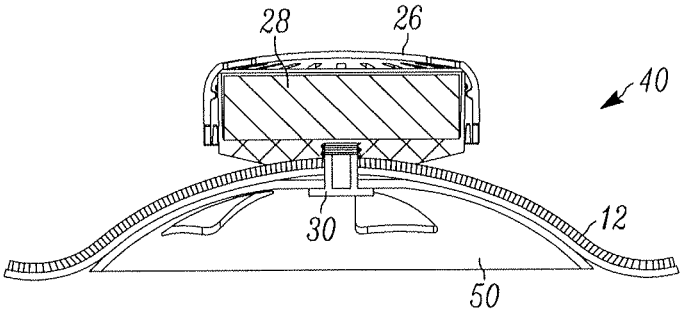
FIG. 16 is an elevational, cross-sectional view of the domed urinal screen assembly of FIG. 15 with the leg sections having been removed.

In another embodiment depicted in FIGS. 14-15, the support stand 38' can be structured with leg portions 44' attached to a domed center section 50'. The leg portions 44' are configured to be removable to provide a domed screen arrangement at a lowered height, as shown in FIG. 16.

Figure 17:
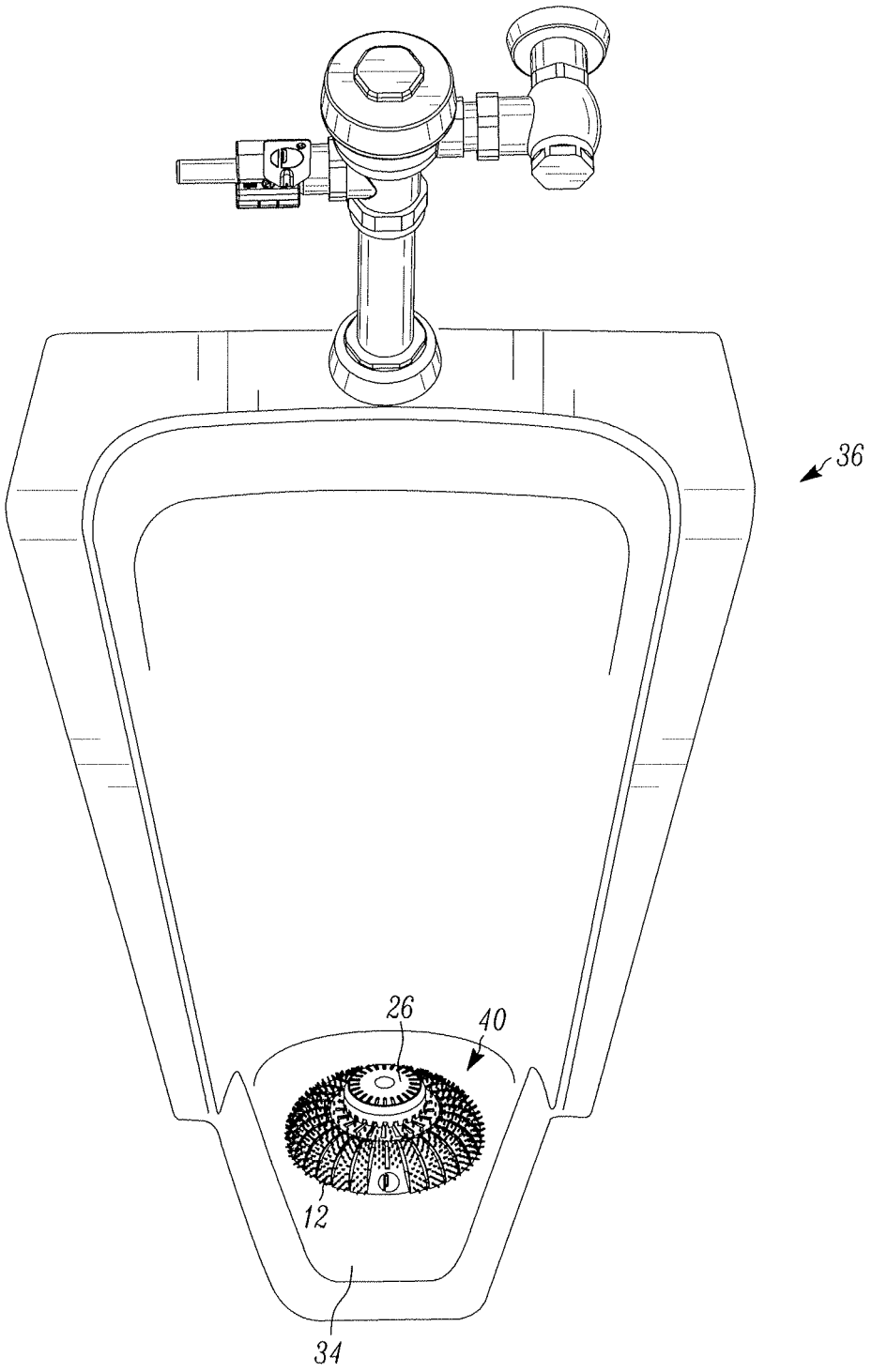
FIG. 17 is a perspective view of the domed urinal screen assembly of FIG. 9 installed over a drain of an embodiment of a floor mount urinal.
Figure 18:
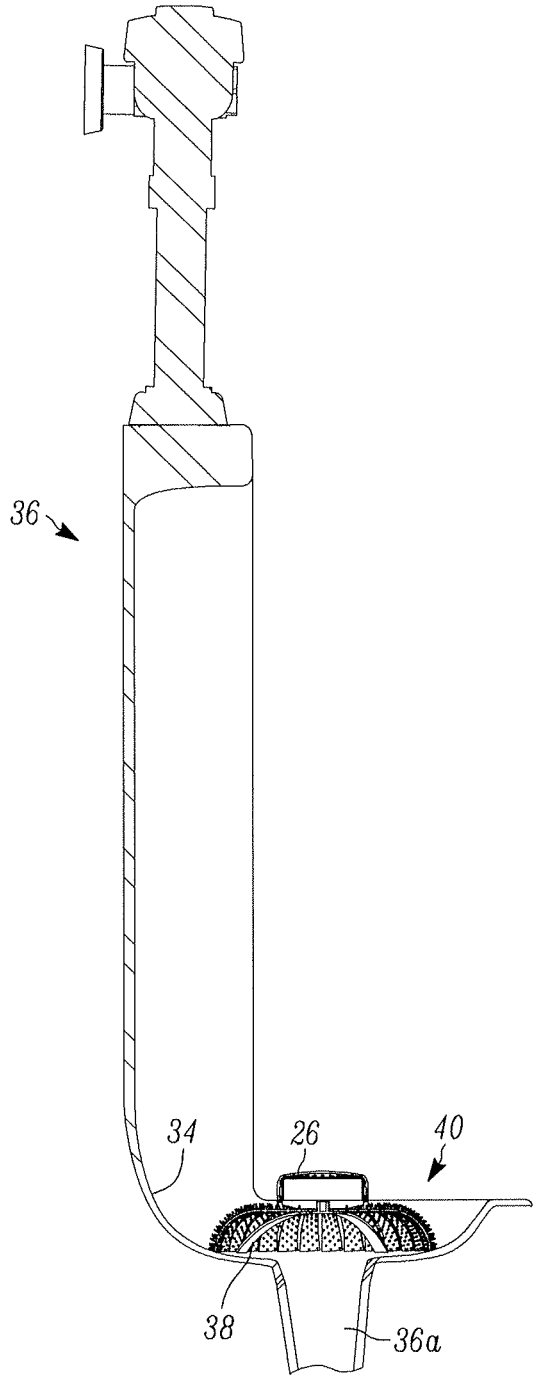
FIG. 18 is an elevational, cross-sectional view of the floor mount urinal and domed urinal screen assembly depicted in FIG. 17.
Figure 19:
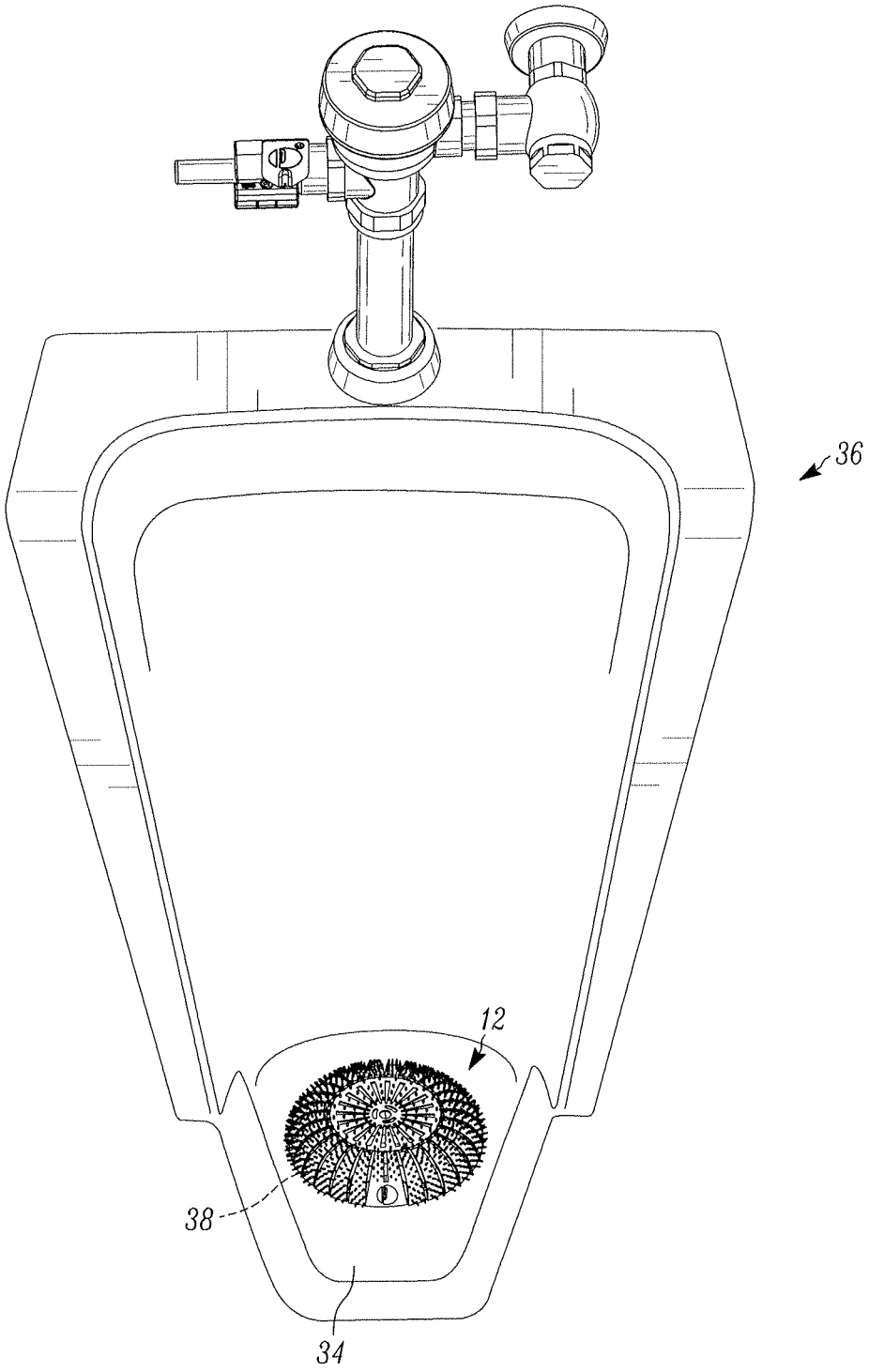
FIG. 19 is a perspective view of the urinal screen shown in FIG. 9 installed as a domed screen over a drain of an embodiment of a floor mount urinal.

In use, the domed screen assembly 40 can be installed over a drain 36*a* of a urinal 36 as depicted in FIGS. 17-18 showing the screen 12 with an attached fragrance/cleaner module 26. In other embodiments, as shown in FIG. 19, the domed screen 12 with an underlying arched screen support can be used alone over a urinal drain.

It is specifically intended that the present disclosure not be limited to the embodiments and illustrations contained herein, but include modified forms of those embodiments including portions of the embodiments and combinations of elements of different embodiments as come within the scope of the following claim.

We claim:

1. A fixture screen assembly, comprising:

a flexible screen in a circular configuration comprising a circumference, a center portion and an outer portion encircling the center portion, the outer portion comprising individual elongate, flexible strips extending radially outward from the center portion to an outer perimeter such that the entire outer perimeter is separated into said flexible strips, each of the flexible strips having a distal end; and a support stand attached to the center portion of the screen, wherein the support stand comprises a plurality of arched leg sections;

wherein the flexible screen overlies the support stand in a domed configuration such that upon placement of the support stand on a surface of a substrate, the distal ends of the flexible strips are in contact with the substrate about the entire circumference of the screen, and the screen about the circumference is conformable to contours of the surface of the substrate.

2. A fixture screen assembly, comprising:

a flexible screen comprising a center portion and a contiguous outer portion encircling the center portion, and a circumference, the outer portion comprising separated elongated, flexible strips extending radially outward from the center portion to an outer perimeter such that the entire outer perimeter about the circumference of the screen is separated into said flexible strips, each of the flexible strips having a distal end; and an arched support stand sized for receiving the flexible screen thereover such that the flexible screen is in a domed configuration and with the center portion of the screen elevated;

wherein upon placement of the support stand on a surface of a substrate and with the center portion of the screen attached to the support stand, the distal ends of the flexible strips are in physical contact with the surface of the substrate about the entire circumference of the screen, and the screen about the circumference is conformable to contours of the surface of the substrate.

3. The screen assembly of claim 2, wherein the flexible strips in contact with the surface of the substrate about the circumference of the screen prevent debris from passing under the arched support stand.

4. The screen assembly of claim 2, wherein the support stand is adjustable in height.

5. The screen assembly of claim 2, further comprising a module configured for containing a cleaner and/or fragrance material, the module attachable to the center portion of the screen.

6. The screen assembly of claim 2, further comprising a flexible, circular support structure situated between the screen and the arched support.

7. The screen assembly of claim 2, wherein the outer portion of the screen comprises a plurality of elongate strips extending radially outwardly from the center portion of the screen in an orientation perpendicular to the center portion.

8. The screen assembly of claim 2, wherein the outer portion of the screen comprises a plurality of elongate strips extending radially outwardly from the center portion of the screen in a spiral configuration.

9. The screen assembly of claim 2, wherein the outer portion of the screen comprises a plurality of elongate strips extending radially outwardly from the center portion of the screen in a zigzag configuration.

10. The screen assembly of claim 9, wherein one or more of the elongated strips of the screen comprise a plurality of bent arm portions connected together at an angle.

11. The screen assembly of claim 2, wherein one or more of the elongated strips of the screen comprise multiple protrusions extending from a surface of the strip.

12. The screen assembly of claim 2, wherein the support stand is attached to the center portion of the screen.

13. A fixture screen assembly, comprising:

a flexible screen comprising a center portion and a outer portion encircling the center portion, and a circumference, the outer portion comprising separated elongated, flexible strips extending radially outward from the center portion to an outer perimeter such that the entire outer perimeter about the circumference of the screen is separated into said flexible strips, each of the flexible strips having a distal end; and an arched support stand sized for receiving the flexible screen thereover such that the flexible screen is in a domed configuration and with the center portion of the screen elevated;

wherein upon placement of the support stand on a surface of a substrate and with the center portion of the screen attached to the support stand, the distal ends of the flexible strips are in physical contact with the surface of the substrate about the entire circumference of the screen, and the screen about the circumference is conformable to contours of the surface of the substrate;

wherein the support stand is composed of a plurality of arched leg sections.

14. The screen assembly of claim 13, wherein the module contains a material comprising a cleaning agent, fragrance, or a combination thereof.

15. The screen assembly of claim 14, wherein the material is a block, gel or liquid material.

16. The screen assembly of claim 14, wherein the module comprises a base section and a cover.

17. The screen assembly of claim 14, wherein the module is situated on the center portion of the screen, and the arched leg sections are attached together under the screen and to the module.

* * * * *